US006754455B2

(12) United States Patent
Kawase

(10) Patent No.: US 6,754,455 B2
(45) Date of Patent: Jun. 22, 2004

(54) IMAGE FORMING APPARATUS AND DEVELOPER SUPPLY METHOD THEREFOR, AND IMAGE PROCESSING BOARD

(75) Inventor: Michio Kawase, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/206,094

(22) Filed: Jul. 29, 2002

(65) Prior Publication Data

US 2003/0026622 A1 Feb. 6, 2003

(30) Foreign Application Priority Data

Jul. 31, 2001 (JP) ..... 2001-232759

(51) Int. Cl.[7] ..... G03G 15/00; G03G 15/08
(52) U.S. Cl. ..... 399/27; 358/1.16; 399/8
(58) Field of Search ..... 399/8, 9, 27, 24, 399/53; 358/1.15, 1.18, 530, 443, 462

(56) References Cited

U.S. PATENT DOCUMENTS 6,166,826 A * 12/2000 Yokoyama
6,476,837 B2 * 11/2002 Ogata
6,510,294 B1 * 1/2003 Hakamada
2002/0090222 A1 * 7/2002 Ahn et al.
2002/0114636 A1 * 8/2002 Phillips et al.

FOREIGN PATENT DOCUMENTS

JP 2000-207164 7/2000

* cited by examiner

*Primary Examiner*—Sophia S. Chen
(74) *Attorney, Agent, or Firm*—Fitzpatrick, Cella, Harper & Scinto

(57) ABSTRACT

Image data is stored into an image memory, then an image processing unit performs image processing on the image data stored in the image memory and generates information on a predicted amount of developer consumed in image formation, based on the image data resulted from the image processing. A printer forms an image by using the developer based on the processed image data, thereafter, the developer is supplied in correspondence with the information on the predicted consumption amount of the developer. Thus, primary image processing functions can be integrated on an image processing board, and the developer consumption amount can be predicted by the image processing board based on the image data.

15 Claims, 8 Drawing Sheets

IMAGE FORMING APPARATUS AND DEVELOPER SUPPLY METHOD THEREFOR, AND IMAGE PROCESSING BOARD

FIELD OF THE INVENTION

The present invention relates to an image forming apparatus, a developer supply method for the apparatus and an image processing board, and more particularly, to a developer supply method in an image forming apparatus which forms an image in accordance with an electrophotographic method.

BACKGROUND OF THE INVENTION

In recent years, computers in respective places of the world are linked via the Internet, and various information searches and browsing are made by utilizing the network. Generally, a computer holding a software program specialized for browsing information (hereinafter referred to as a "browser") is connected to a server linked to WWW (World Wide Web) via the network, and information on the WWW server is referred to in accordance with HTTP (Hyper Text Transfer Protocol) protocol from the computer.

Further, this browser can download the browsed information on the WWW server to the computer and stores the information there. As the information stored in the computer can be outputted to an image output apparatus having a printing function and print-outputted from the image output apparatus in accordance with necessity, various information on the WWW server can be stored in a recording medium or print-outputted.

Generally, a laser-beam printer which forms an image in accordance with an electrophotographic method or an ink-jet printer which performs image printing in accordance with an ink-jet method are used as the image output apparatus. These printers performs image processing on image data transmitted from a connected host device such as a computer to convert the data to data of appropriate format to the printer.

However, in the conventional printers, as fixed image processing is always performed regardless of image data type or contents, the following problems occur.

In image data of photograph or the like, tonality is important, while image data of illustration or the like, resolution is important. In the conventional art, the same image processing is performed on all the image data, therefore, in some cases, the tonality of image data of photograph or the like is impaired or the resolution of image data of illustration or the like is damaged.

It is difficult to output data with optimum color tone corresponding to each image data since fixed gamma conversion processing is performed. Similarly, it is difficult to output data with optimum color tone corresponding to each image data since the same under color processing is performed.

To solve this problem, Japanese Published Unexamined Patent Application No. 2000-207164 discloses an image processing apparatus which performs image formation based on image data obtained from a network. In the apparatus, it is determined whether the image is a tonality-oriented image or a resolution-oriented image from the extension of image file, and image processing corresponding to the type of image data is performed.

Further, an image formation apparatus such as an electrophotographic-type digital copying apparatus is often used. This apparatus converts an original image by a reading device and obtains a printed image. In this image forming apparatus, image data transmitted from a computer is transferred to the image forming apparatus via an external apparatus.

The external apparatus, which accesses the network to obtain image data, converts the obtained image file into a raster image, and performs image processing to obtain an appropriate printed image, has a large scale hardware since it includes various processing circuits. However, in recent years, the hardware circuits are highly integrated, and in some cases, such external apparatus is incorporated in the image forming apparatus.

Further, it is recently necessary for the above-described printer apparatus as a computer peripheral device to have product specifications to selectively hold various image processing boards in accordance with a user's preferences and to attain user's desired cost and functions. That is, a part or all of image processing circuits must be exchangeable.

In this manner, designing for flexible arrangement of image processing circuits is required in the image output apparatus. On the other hand, image processing methods are increasingly progressed, and various image processings are proposed corresponding to various image data characteristics by original images and characters. Further, an arrangement to perform appropriate image processing automatically or in correspondence with a user's designation has been proposed. In this case, it is difficult to independently perform processing on the image processing circuit side and processing on the printer engine side.

For example, in an image forming apparatus having a function of predicting the amount of consumption of toner (developer) in correspondence with image data and performing toner density control, image processing closely related to printer control such as gamma conversion is performed on the printer engine side. That is, as part of control of image formation means of image forming apparatus, image processing corresponding to engine characteristic is performed on the printer engine side and the engine characteristic is corrected. The printer engine receives image data, performs integration processing on the image data, predicts the amount of toner consumption from the result of integration, and controls toner supply to a developer unit.

Further proposed is an image forming apparatus which forms a toner patch image on an electrostatic drum, measures toner density in the developer unit, and controls toner supply with high precision from the result of integration of image data and toner density information in the developer unit.

On the contrary, a low-cost printer engine has been provided by omitting primary image processing functions on the printer engine side of image forming apparatus upon constructing a high-level and large-scale image processing circuit and providing an image processing board instead of the primary image processing.

In this manner, if the construction of image processing circuit of image forming apparatus is reviewed in more detail, it is understood that to provide various image processing functions with a flexible construction of image processing circuit, it is desirable to handle necessary information not on the printer engine side but on the image processing board side.

However, as described above, in the conventional image forming apparatuses, necessary information is handled almost on the printer engine side regarding toner supply control which is closely related to the printer characteristic.

Accordingly, in a case various image processings are to be performed, it is difficult to integrate primary image processing functions on the image processing board.

SUMMARY OF THE INVENTION

Accordingly, the first object of the present invention is to provide an image forming apparatus which performs appropriate toner supply control by predicting the amount of toner consumption based on image data even in a flexibly-constructed image processing board for various image processings is used in the image forming apparatus.

The second object of the present invention is to provide a developer supply method for an image forming apparatus by predicting the amount of toner consumption based on image data even in a flexibly-constructed image processing board for various image processings is used in the image forming apparatus.

The third object of the present invention is to provide an image processing board having a flexible construction for various image processings, which integrates respective data values of processed image data and outputs the integrated value.

According to one aspect of the present invention, the foregoing first object is attained by providing an image forming apparatus which forms an image in accordance with an electrophotographic method, comprising: storage means for storing image data; image processing means for performing image processing on the image data stored in the storage means; and image formation means for forming an image using developer based on the image data processed by the image processing means, wherein the image processing means includes developer consumption amount calculation means for generating information on a predicted amount of the developer consumed by the image formation means, based on the image data processed by the image processing means, and wherein the image formation means supplies the developer in correspondence with the information generated by the developer consumption amount calculation means.

According to the image forming apparatus of the present invention, image data is stored in the storage means, and the image processing means performs image processing on the image data stored in the storage means and generates information on the amount of developer as a predicted amount of developer consumed upon image formation, and the image formation means forms an image by using the developer based on the image-processed image data, and supplies the developer in correspondence with the information on the predicted developer consumption amount.

In this manner, as primary image processing functions can be integrated on an image processing board as the image processing means, even in a case a flexibly-constructed image processing board for various image processings is used in the image forming apparatus, the amount of consumption of developer is predicted based on image data and appropriate developer supply control can be performed.

Note that it is desirable that the image processing means changes the image processing on the image data based on whether the image data represents a tonality-oriented image or a resolution-oriented image, and wherein the developer consumption amount calculation means corrects the information in correspondence with executed image processing.

In this case, it is preferable that the image processing means determines whether the image data represents a tonality-oriented image or a resolution-oriented image based on an extension included in a file name of the image data.

Further, it may be arranged such that the image forming apparatus is connected to a network, and the apparatus further comprises: input means for inputting information on the image data; and issuance means for issuing an image request to the network based on the information inputted by the input means, and the storage means holds image data transmitted in response to the image request by the issuance means.

Further, it is preferable that the image forming apparatus further comprises reading means for reading an original image and generating image data, and the storage means holds the image data generated by the reading means.

According to another aspect of the present invention, the foregoing second object is attained by providing a developer supply method for the image forming apparatus, wherein at the image processing step, the image processing on the image data is changed based on whether the image data represents a tonality-oriented image or a resolution-oriented image, and wherein at the developer consumption amount calculation step, the information is corrected in correspondence with executed image processing.

The above second object is also attained by providing a computer program including program code corresponding to the respective steps of the above developer supply method for image forming apparatus, and a storage medium holding the computer program.

According to another aspect of the present invention, the foregoing third object is attained by providing an image processing board of an image forming apparatus which forms an image in accordance with an electrophotographic method, comprising: an image processing circuit that performs image processing on input image data by using a parameter designated from pre-set plural parameters; and an integration circuit that integrates each data value upon output of the image data resulted from to the image processing.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
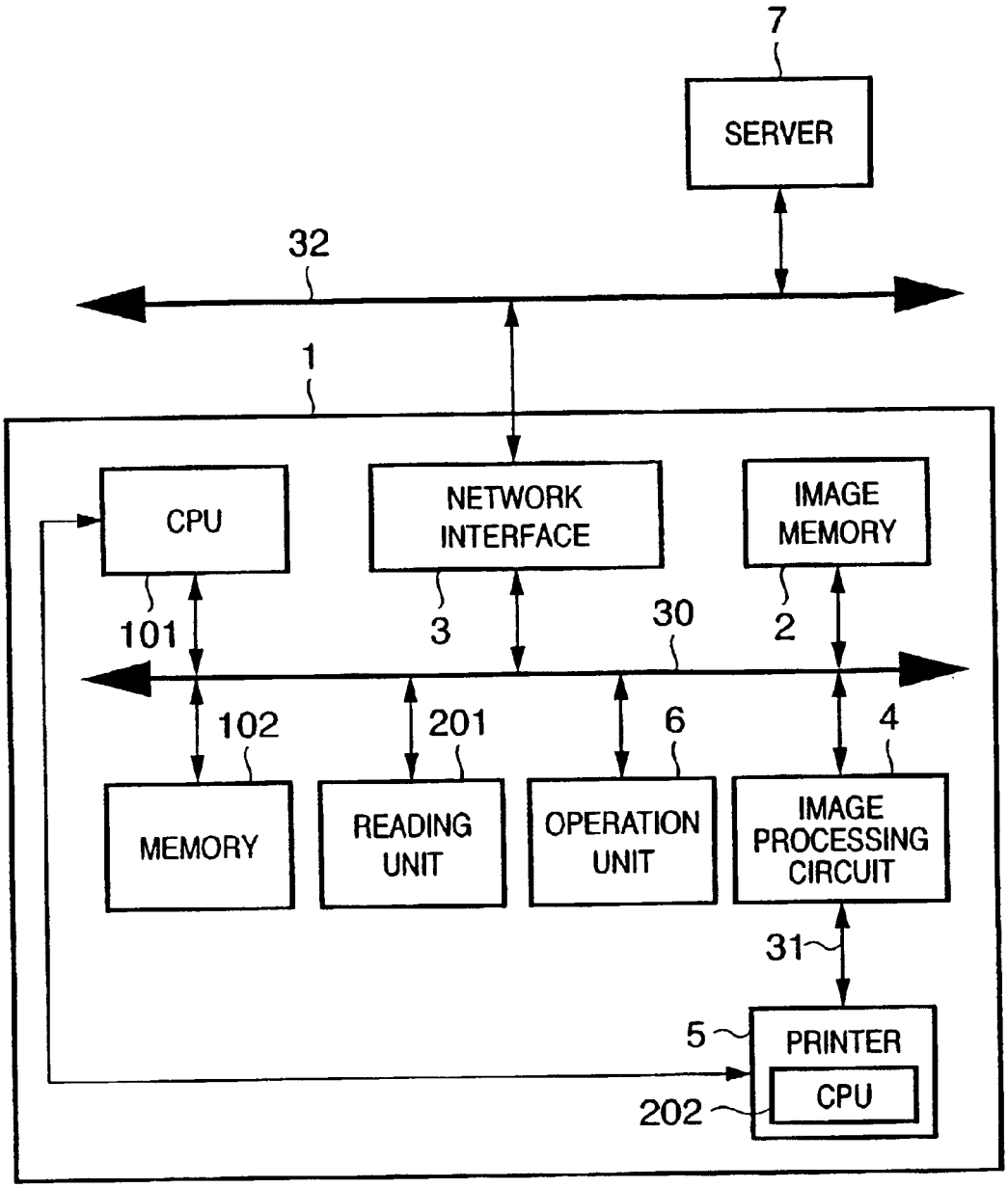
FIG. 1 is a block diagram showing a system configuration including an image forming apparatus according to a first embodiment of the present invention.

Preferred embodiments of the present invention will now be described in detail in accordance with the accompanying drawings.

First, image processing performed in the following embodiments will be briefly described.

For example, GIF and JPEG are general image file formats on the internet. In the GIF file format, an image is compressed by reversible compression and held in the compressed form. The number of displayable colors is limited to 256. Accordingly, the GIF file format is often used for image data including a comparatively small number of colors such as illustrations and drawings.

In the JPEG file format, an image is compressed by irreversible compression and held in the compressed form, and a very large number of colors, about 16,770,000 colors are displayable. Accordingly, the JPEG file format is often used for image data of natural image such as digitized photographs.

On the other hand, upon image printing by electrophotography or the like, if the resolution of image to be printed is increased, the waveform of analog signal used as a pattern signal in pulsewidth modulation (PWM) or the like cannot be shaped to ideal triangular form without difficulty, and printing in ideal tonality cannot be performed without difficulty.

In the embodiments, resolution-oriented image data is print-outputted in high resolution, while color tonality-oriented image data is print-outputted in low resolution.

Further, since setting of smoothing for image data of illustration, drawing or the like is often different from that for image data of photograph, natural image or the like, image enhancement or smoothing setting according to the embodiments can be made in correspondence with the format of each image data.

In addition, in a case where RGB image data is print-outputted by an electrophotographic type printer, it is necessary to convert the image data in RGB representation is converted to C (cyan), M (magenta), Y (yellow), K (black) density values, and send the converted image data to the printer. In this case, in a gray image using CMY toner, since the gray color includes some color, the gray part should be printed by using only the black (K) toner. On the other hand, in printing of gray part by using only the black toner, if the part is a grayscale image smoothly changing from the gray color to another color, the reproduced tonality of the part is impaired. Accordingly, in the electrophotographic type printer, image formation is generally performed by combination of CMY toner and K toner at an appropriate ratio. In this case, the processing of replacing the CMY with the K is called Under Color Removal (UCR). In the embodiments, the ratio between the YMC and K in the under color removal can be set in correspondence with the format of each image data.

Further, in use of binary printer or the like where 1 pixel area is not variable or varied by very limited amount, a tonality image can be printed by changing the number of color pixels per unit area or the combination of the color pixels. This image representation is called area tone representation. In this method, original image data is processed by dither processing, error diffusion method (dither) or the like, thereby converted to image data having only printable colors in the printer. In this area tone representation processing, setting of area tone representation processing can be made in correspondence with the format of each image data by adopting optimum conversion processing in accordance with whether image data of photograph or the like is to be print-outputted or image data of illustration or the like is to be print-outputted.

[First Embodiment]

Hereinbelow, the preferred embodiments of the present invention will be described in detail with reference to the attached drawings.

As a first embodiment, described is an image forming apparatus which transmits a command by using the HTTP protocol to a server holding a desired image data, designated by a user from an operation unit, and in correspondence with a response from the server, obtains the image data stored in the server and forms an image.

FIG. 1 is a block diagram showing a system configuration including an image forming apparatus 1 according to the first embodiment of the present invention. The image forming apparatus 1 is connected to a network 32.

In FIG. 1, reference numeral 2 denotes an image memory which holds image data from e.g. an original image reading unit 201 or image data inputted via the network 32 and a network interface 3. The network interface 3 controls communication with another device connected to the network 32 via the network 32. Numeral 4 denotes an image processing circuit which performs various image processings on image data stored in the image memory 2, and outputs the processed image data to a printer 5. The printer 5 functions as image formation means which inputs the image data from the image processing circuit 4 and forms an image on a print medium such as a print sheet.

Numeral 6 denotes an operation unit which is used by the user for designation of location (server or the like) where image data to be print-outputted is stored; 7, a server connected to the network 32, holding various image data; 30, a system bus through which data transmission/reception is performed between a CPU 101 which controls the overall image forming apparatus 1 of the present embodiment and the respective units; and 31, a video bus which is used for transmission of image data generated by the image processing circuit 4 to the printer 5. The network 32 functions as a communication path for interconnection between the image forming apparatus 1 and the server 7 and for transmission/reception of various data between these apparatuses. Numeral 102 denotes a memory which is also used as a work area for temporarily storing a program executed by the CPU 101 or various data when the CPU 101 operates.

A CPU 202 of the printer 5 performs data transmission/reception between the printer and the CPU 101, and controls paper conveyance in the printer 5 and a series of printer engine processes including toner image formation, toner supply, transfer onto print sheet, fixing and the like.

Upon reading from an original image, a COPY key of the operation unit 6 is depressed, thereby image data read by the reading unit 201 is read into the image memory 2, subjected to predetermined image processing by the image processing circuit 4 and sent to the printer 5, thus an image is formed on a print medium.

Next, the HTTP protocol will be described. The HTTP protocol is a TCP/IP protocol service used for transfer of data described in HTML (Hyper Text Markup Language) or image data. Generally, the protocol is used in a system where a client computer which issues a data transfer request and a server which holds the data are interconnected via a network.

On the client computer, an HTTP client is operated by the user to input an URL which is a designation form for designation of location where the data is held. In response to the input, the HTTP client issues an information transfer request to the server.

In the HTTP protocol, a GET command as a data request command and a HEAD command as a command for request for data-related information of the data are used. Generally, the type of data to be obtained is determined by using the HEAD command, thereafter, the data is obtained by using the GET command, and processing is performed based on the obtained data.

The data-related information obtained by the HEAD command includes data format information called "Content-type" in addition to data size information, update time information and the like. As data described in HTML has an extension "text/html"; GIF image data, an extension "image/gif"; and JPEG image data, an extension "image/jpeg", the type of data can be determined from the extension.

Assuming that the server 7 has a host name "host.co.jp" and the location of data to be obtained is "/pub/image.GIF", an URL "http://host.co.jp/pub/image.GIF" is inputted, thereby the HTTP client issues the HEAD command for "/pub/image.GIF" to the server "host.co.jp".

The server 7 receives the command, then transmits the format information of the data "/pub/image.GIF" as a response to the HEAD command to the HTTP client.

The HTTP client receives the response, then issues the GET command for "/pub/image.GIF" to the server "host.co.jp".

The server 7 receives the GET command, then transmits the data of "/pub/image.GIF" as a response to the GET command to the HTTP client.

The HTTP client receives, as the response to the GET command from the server, the data of the format information "/pub/image.GIF", and performs processing on the received data.

In this manner, the HTTP client obtains the designated data stored in the designated server 7, with the data-related information, based on the URL inputted from the operation unit 6. Note that the flow of the processing will be described later with reference to the flowchart of FIG. 4.

Figure 2:
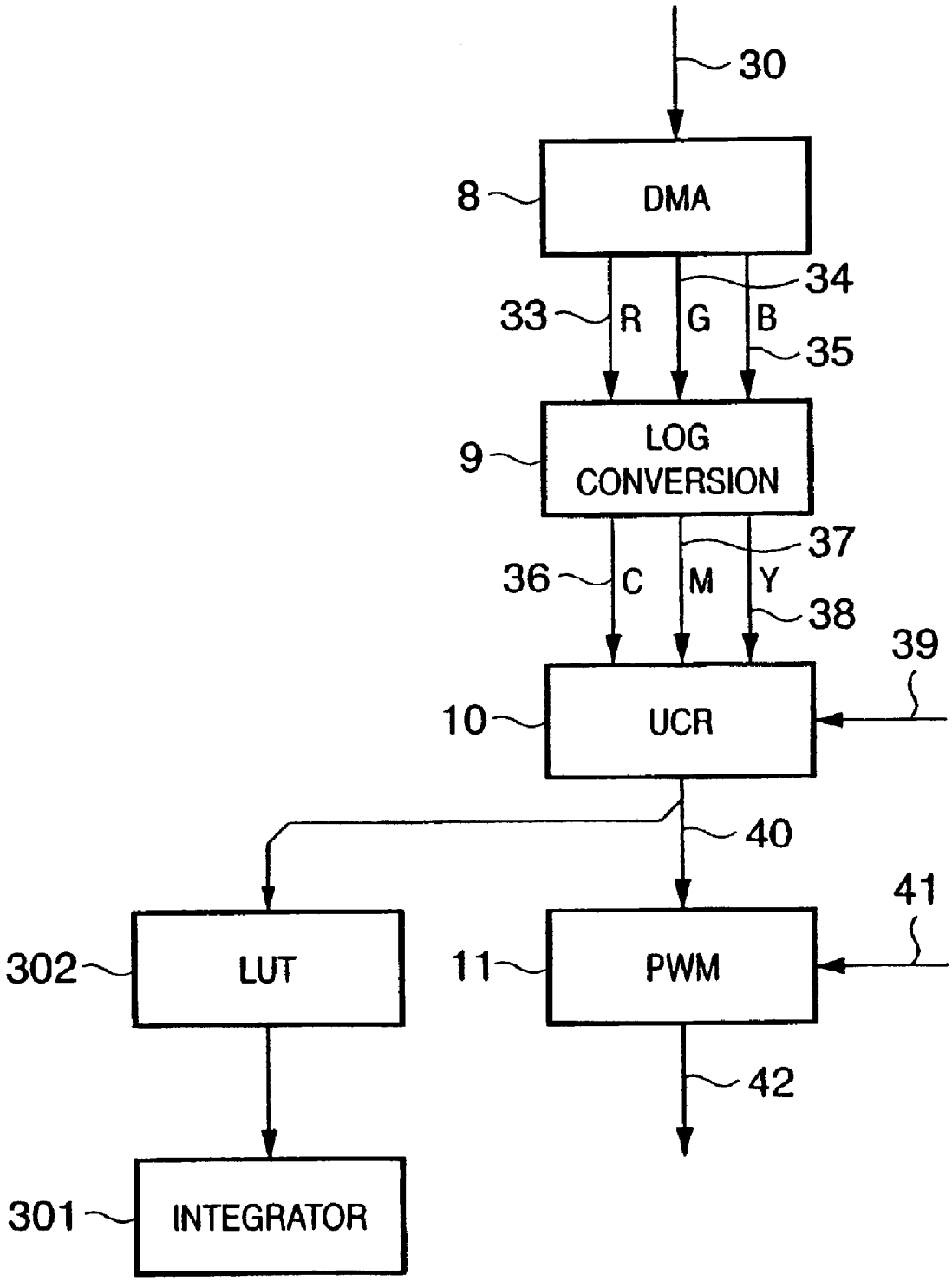
FIG. 2 is a block diagram showing the construction of image processing circuit according to the first embodiment.

Next, the construction of the image processing circuit 4 according to the present embodiment will be described. FIG. 2 is a block diagram showing the construction of the image processing circuit 4 according to the present embodiment.

In FIG. 2, numeral 8 denotes a DMA data transfer circuit which controls DMA data transfer from the image memory 2 to the image processing circuit 4; 9, a LOG conversion circuit which converts RGB image data into CMY image data; 10, an UCR circuit which performs UCR processing on the CMY image data to generate CMYK image data 40; and 11, a PWM (pulsewidth modulation) circuit which generates a laser drive signal 42 for laser on/off control from the CMYK image data.

Numeral 33 denotes an R data signal indicating red component data of the image data; 34, a G data signal indicating green component data of the image data; 35, a B data signal indicating blue component data of the image data; 36, a C data signal indicating cyan component data of the image data; 37, an M data signal indicating magenta component data of the image data; and 38, a Y data signal indicating yellow component data of the image data. Further, numeral 39 denotes a color selection signal for selection of color of which image formation is to be made; 40, a data signal selected from the CMYK data; 41, a clock signal as a reference synchronizing signal for PWM processing; and 42, the laser drive signal for laser on/off control.

The DMA data transfer circuit 8 is connected to the system bus 30, and is controlled by the CPU 101 that controls the overall image forming apparatus 1 via the system bus 30. In a case where image data stored in the image memory 2 is DMA transferred to the image processing circuit 4 under the control of the DMA data transfer circuit 8, first, addresses of the image memory 2 where the respective R, G and B image data are stored, and the size of data to be transferred are set by the CPU 101 for the DMA data transfer circuit 8. Thereafter, the DMA data transfer circuit 8 sequentially reads the respective R, G and B data from the designated addresses of the image memory 2 by DMA, and outputs the read data as the R data signal 33, the G data signal 34 and the B data signal 35, to the LOG conversion circuit 9 such that the tree R, G and B data are outputted in synchronization with each other. That is, the R, G and B data of each pixel of the image data are simultaneously outputted.

Then the C data signal 36, the M data signal 37 and the Y data signal 38 are generated from the R data signal 33, the G data signal 34 and the B data signal 35 inputted into the LOG conversion circuit 9, and the C, M and Y data signals are outputted. At this stage, the luminance R, G and B data are converted to the C, M, and Y density data.

The C data signal 36, the M data signal 37 and the Y data signal 38 outputted from the LOG conversion circuit 9 are inputted into the UCR circuit 10. The UCR circuit 10 extracts a black component as a common component from the respective C, M and Y data and outputs the extracted black component. The extraction of black component is realized by determining a color having a minimum value among C, M and Y data in each pixel, integrating the minimum value and a predetermined coefficient thereby determining a value of K data as data for black toner, subtracting the K data value from the respective C, M, and Y data thereby calculating values of respective C', M' and Y' data.

For example, if a coefficient for generation of black toner data is 80%, C=20, M=90 and Y=100 hold, as the minimum value is "20", the following image data is generated.

C': 4 (C−K)

M': 74 (M−K)

Y': 84 (Y−K)

K: 16 (20×80%=16)

Further, the UCR circuit 10 also inputs the color selection signal 39 which is necessary for selecting one of the C', M', Y' and K image data upon image formation of C, M, Y, K, since the printer 5 employs an image formation method of sequentially forming C, M, Y and K images.

In response to the input of the color selection signal 39, one of the C', M', Y' and K data is outputted as the data signal 40.

The data signal 40 outputted from the UCR circuit 10 is pulsewidth modulated by the clock signal 41 as a triangular wave in the PWM circuit 11. By this pulsewidth modulation, the data signal which has been inputted as e.g. 8-bit data is modulated in synchronization with the clock signal 41, to a pulsewave having a pulsewidth corresponding to the value of the data signal 40. Further, in the PWM circuit 11, the input clock signal 41 may be divided by 2 for PWM at a frequency ½ of that of the clock signal 41.

In correspondence with output of the image data signal 40 selected by the color selection signal 39 from the C', M', Y' and K data, the image data signal is corrected by using a look-up table (LUT) 302, and sent to an integrator 301, in which the corrected image data is integrated. The integrator 301 performs integration in correspondence with each toner color, then the CPU 101 reads the result of integration and stores it into the memory 102. The CPU 101 reads the result of integration by toner color from the memory 102, and immediately notifies them as toner consumption prediction data to the CPU 202 of the printer 5.

The LUT 302 having a random access memory rewritable by the CPU 101 holds correction data for each toner color for correcting image data in accordance with printer characteristic. For example, in a resolution-oriented image, PWM is performed at the frequency of the clock signal 41, while in a tonality reproducibility-oriented image, PWM is performed at a frequency ½ of that of the clock signal 41. Accordingly, as the amount of toner consumption somewhat differs even in the same image data, correction data for integration of proper amount of toner consumption is stored in advance in the LUT 302, and the contents of the LUT 302 are written in correspondence with any of the PWM mode. Otherwise, both correction data are stored in advance in the LUT 302 and the CPU 101 controls the higher-order address of the LUT 302 for referring to one of the correction data in correspondence with PWM mode.

Figure 3:
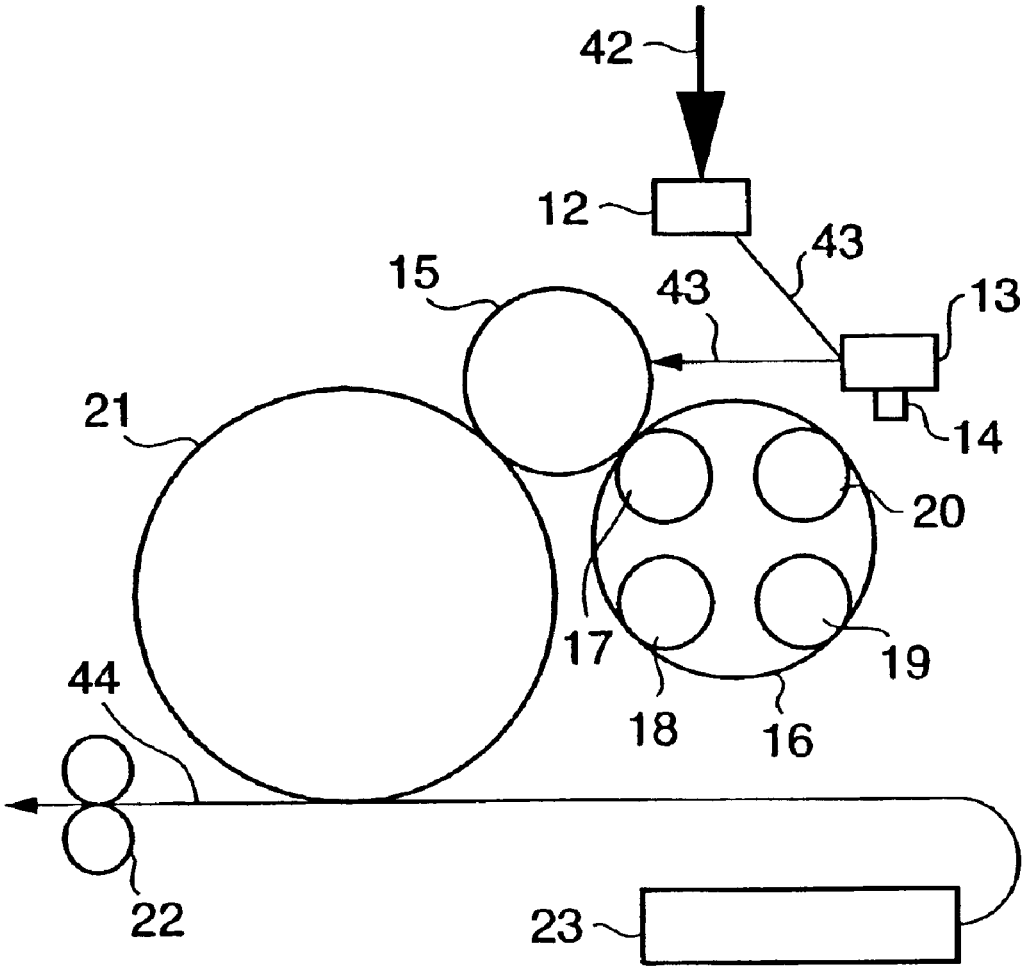
FIG. 3 is a block diagram showing the structure of printer according to the first embodiment.

Next, the structure of the printer 5 according to the present embodiment will be described with reference to the block diagram of FIG. 3.

Figure 5:
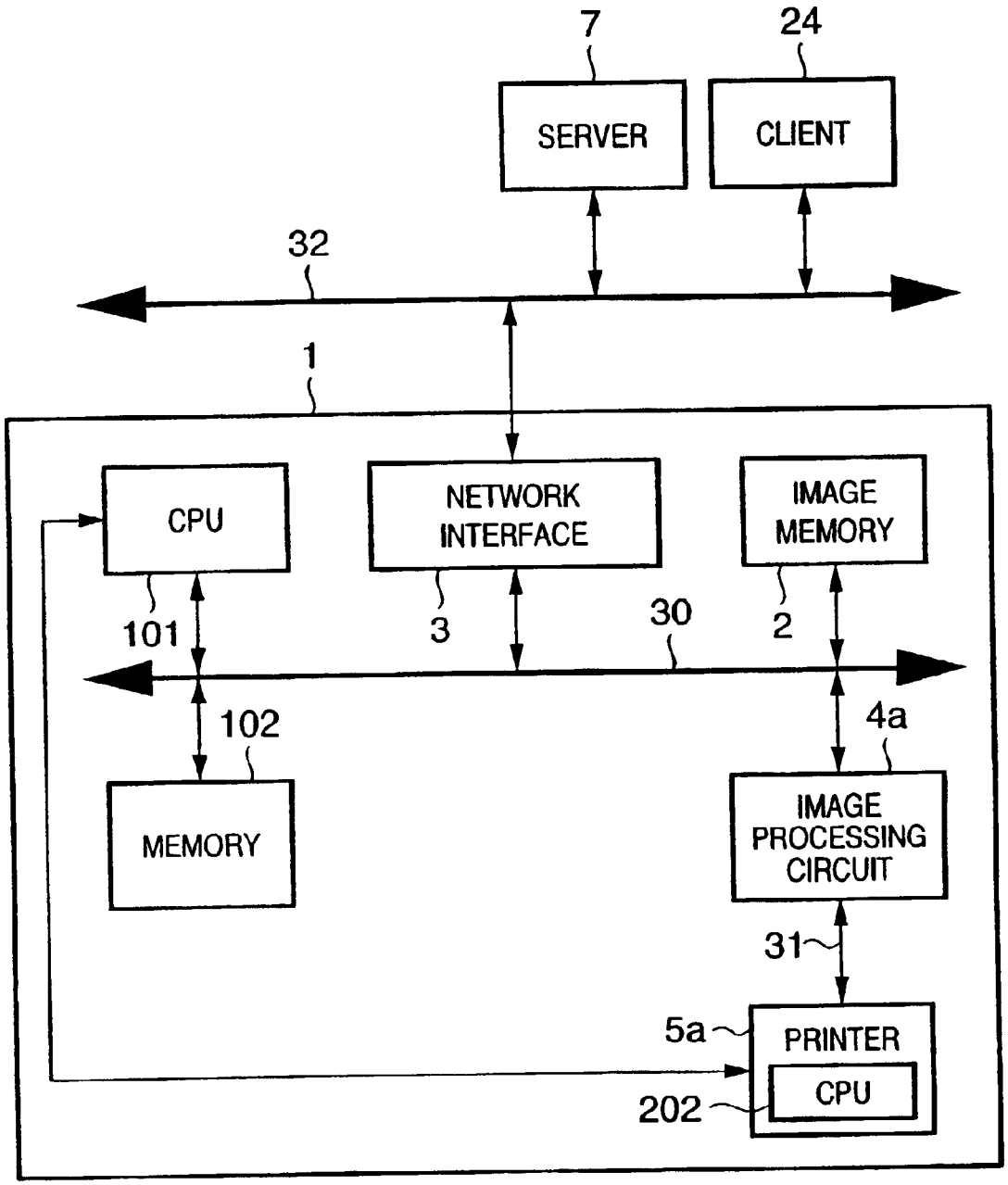
FIG. 5 is a block diagram showing the system configuration including the image forming apparatus according to a second embodiment of the present invention.

In FIG. 5, numeral 12 denotes a semiconductor laser which outputs laser light in correspondence with an input signal; 13, a polygon mirror having a shape of hexagonal prisms with mirror-finished side surfaces, which rotates in correspondence with driving of polygon motor 14; 15, an electrostatic drum on which a latent image is formed by the laser light, and a toner image is formed by electrostatic attraction of toner in a developer unit to the latent image; 16, a revolver holding C, M, Y and K toner cartridges, which rotates in correspondence with a color selected upon development; 17, a C (cyan) toner cartridge; 18, an M (magenta) toner cartridge; 19, a Y (yellow) toner cartridge, and 20, a K (black) toner cartridge. The respective toner cartridges have a toner bottle containing toner and a developer unit containing developer including two components, magnetic carrier and toner. At each color development process, a sleeve of the developer unit rotates, a latent image is developed with the developer on the sleeve, and a predetermined amount of toner is supplied from the toner bottle to the developer unit, thereby an approximately constant toner density of the developers is maintained in the developer unit of the toner cartridge.

Numeral 21 denotes a transfer drum on which a print sheet is attracted, and the toner on the electrostatic drum is transferred onto the print sheet; 22, a fixing drum which fixes the toner onto the print sheet; 23, a paper feed cassette holding print sheets which feeds a print sheet upon image formation; 42, the laser drive signal; 43, a laser beam emitted from the semiconductor laser 12; and 44, a paper conveyance path.

The printer 5, which performs image formation by the electrophotographic method, forms an image on a print sheet by using C (cyan), M (magenta) Y (yellow) and K (black) toner. Upon image formation, first, a print sheet held on the paper feed cassette 23 is supplied, then the print sheet is conveyed through the paper conveyance path 44, then is attracted to the transfer drum 21 and is attached to the surface of the transfer drum 21. The transfer drum 21 rotates at a constant speed, and the print sheet moves in correspondence with the rotation of the transfer drum 21.

On the other hand, upon printing in the printer 5, the laser drive signal 42 is supplied from the image processing circuit 4. The laser drive signal 42 is one of the C, M, Y and K data pulsewidth modulated by the PWM circuit 11, and the C data signal is first inputted. If the data signal is ON, light emission occurs at a laser light source of the laser 12, and the laser beam 43 is outputted. The laser beam 43 is emitted to the polygon mirror 13. The polygon mirror 13, which rotates by rotation drive of the polygon motor 14, scan-moves the laser beam 43 end to end of the electrostatic drum 15. This one scanning becomes one scanning line in image formation. A latent image is formed on the electrostatic drum 15 by the laser light scanning. The latent image has an electric characteristic that a portion where the laser light is emitted has a high electric potential whereas other portions have a lower electric potential.

The latent image formed on the electrostatic drum 15 is first brought into contact with negatively-charged cyan toner held in the developer coated on the sleeve in a portion where the electrostatic drum 15 comes into contact with the C toner developing sleeve in the C toner cartridge 17. The cyan toner is attracted by electric attraction only to a portion of the electrostatic drum where the laser light is emitted and developed. The portion of the electrostatic drum to which the toner is attracted is moved to the portion in contact with the transfer drum 21 by rotation of the electrostatic drum 15. In the portion where the transfer drum 21 and the electrostatic drum 15 are in contact with each other, the toner attracted to the electrostatic drum 15 is transferred to a print sheet held on the transfer drum 21.

Next, the revolver 16 is ¼ rotated such that the M toner cartridge 18 comes into contact with the electrostatic drum 15, the M data signal is inputted as the laser drive signal 42, and as in the case of the C development, the magenta toner image is transferred to the print sheet. Hereinbelow, development is performed by using Y then K toner. Thus the respective C, M, Y and K toner images are transferred onto the print sheet held on the transfer drum 21.

Thereafter, the print sheet is separated from the transfer drum 21, and passed through the paper conveyance path 44 and between two fixers 22. At this time, the fixers 22 heat and press the print sheet, thereby the toner transferred onto the print sheet is fixed to the print sheet, and discharged to the outside the printer 5. Printing is executed by the above operation.

When the print operation is performed in the printer 5 in this manner, as the toner in the developer unit is consumed, it is necessary in two-component development using toner and magnetic carrier to perform toner supply control to appropriately supply toner by the amount of consumption to maintain an appropriate toner density.

For this purpose, upon print operation, the CPU 202 of the printer 5 controls toner supply from the toner bottles of the C, M, Y and K toner cartridges 17, 18, 19 and 20 to the respective color developer unit units, based on toner consumption amount prediction information for each toner color notified from the CPU 101 to the CPU 202.

In the present embodiment, the printer engine has the transfer drum 21, however, the engine may have a structure for sequentially overlaying 4 color toner images on an intermediate transfer body such as an intermediate transfer drum or intermediate transfer belt in place of the transfer drum and performing one-time transfer on the conveyed print sheet.

Figure 4:
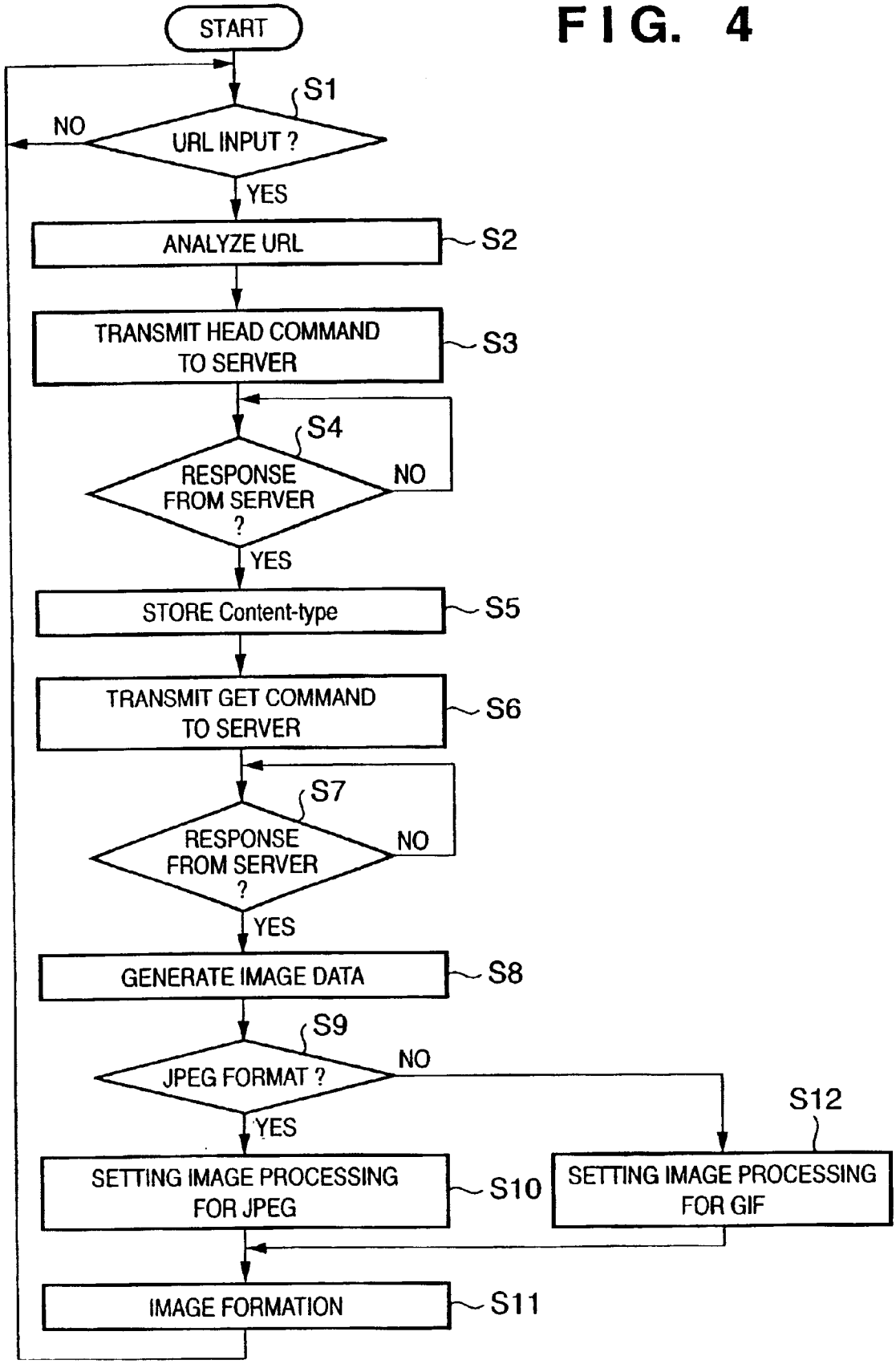
FIG. 4 is a flowchart showing processing in the image forming apparatus according to the first embodiment.

Next, processing operation in the image forming apparatus 1 of the present embodiment will be described with reference to the flowchart of FIG. 4 showing control processing executed by the CPU 101 in the image forming apparatus of the present embodiment. A program for execution of the processing is stored in the memory 102.

The image forming apparatus 1 has the operation unit 6 having buttons, a display and the like. The operation unit 6 is used for operation of the image forming apparatus 1 by the user. At the operation unit 6, the user designates the URL of location of data to be print-outputted. The image forming apparatus 1 is in input waiting status until this input is made (step S1). At step S1, if an URL is inputted, the process proceeds to step S2, at which the structure of the input URL is analyzed, and the address of server holding the desired data and the location of the data in the server are specified. In this example, the data exists in the server 7.

Then the process proceeds to step S3, at which the HEAD command for the data is issued to the server 7 via the network interface 3 and the network 32.

The server 7 receives the HEAD command, generates the format information to the HEAD command based on data-related information of the designated data, and transmits the format information to the image forming apparatus via the network 32 and the network interface 3. At step S4, the format information from the server 7 is received, then the process proceeds to step S5, at which the information "Content-type" is extracted from the format information from the server 7 and the extracted information is stored.

Next, the process proceeds to step S6, at which the GET command for the data to be obtained is issued to the server 7. The GET command is issued to the server 7 via the network interface 3 and the network 32.

The server 7 transmits the data designated by the GET command to the image forming apparatus 1 via the network 32 and the network interface 3.

When the response from the server 7 is received, the process proceeds from step S7 to step S8, at which image data is generated based on the data received from the server 7 and stored in the image memory 2. Next, the process proceeds to step S9, at which it is determined whether the information "Content-type" stored at step S5 indicates a JPEG image. If it is determined that the information indicates a JPEG image, the process proceeds to step S10, otherwise, proceeds to step S12. At step S10, image processing for JPEG image is set for the image processing circuit 4. That is, in the UCR circuit 10, the UCR is set to 80%, and in the PWM circuit 11, PWM at ½ frequency is set.

Further, as the correction data in the LUT 302, correction data for PWM at ½ frequency is stored.

On the other hand, if it is determined at step S9 that the information "Content-type" does not indicate a JPEG image, the process proceeds to step S12, at which setting for GIF image is made for the image processing circuit 4. That is, in the UCR circuit 10, the UCR is set to 100%, and in the PWM circuit 11, PWM at the frequency of the clock signal 41 is set.

Further, as the correction data in the LUT 302, correction data for PWM at the frequency of the clock signal 41 is stored.

Then image processing and PWM have been executed at step S10 and S12, and thereafter, at step S11, image formation is performed by the printer 5 based on the image resulted from the processing and PWM. Further, in correspondence with image type, i.e., as to whether the information "Content-type" indicates a JPEG image or GIF image, image formation at a resolution appropriate to the image type. The image data corrected by the correction data corresponding to the image type is integrated by the integrator, and the result of integration is notified as toner consumption amount prediction information to the printer 5.

Further, upon photocopying of original image, it may be arranged such that a tonality-oriented mode or resolution-oriented mode is designated at the operation 6, and the CPU 101 sets the image processing and the PWM to a tonality-oriented mode or resolution-oriented mode in accordance with the designated mode from the operation unit 6.

As described above, image formation can be performed based on image data stored in the server 7 designated from the operation unit 6.

In this processing, since the black component is extracted from a JPEG image by 80% of UCR, an image having excellent gradation from black to another color can be generated, and further, since PWM is performed at ½ frequency, an image having excellent image tonality can be generated.

Further, since the black component is extracted from a GIF image by 100% of UCR, a pale gray image is formed only by black toner, and the problem of non-gray color which occurs in image generated by combination of C, M, Y and K can be avoided. Further, since PWM is performed at the same frequency as that of the supplied clock signal 41, a high resolution image where jaggies are inconspicuous can be formed.

As described above, according to the present embodiment, a JPEG image is formed by image processing appropriate for printing a natural image such as a photograph, and a GIF image is formed by image processing appropriate for printing an illustration or the like.

As optimum image processing is performed for each image data and image data integration is performed, an appropriate toner consumption amount for each toner is predicted, and the amount is notified to the printer. Thus toner supply control in the printer is performed such that an appropriate developing toner density can be maintained.

Further, the characteristic features of the present embodiment are as follows.

As storage location of data to be obtained is designated at the operation 6 of the image forming apparatus 1, image processing and image formation processing can be performed only in the image forming apparatus 1 and another client apparatus is not necessary. Further, appropriate image processing and appropriate toner consumption amount prediction can be performed in correspondence with type of image data to be obtained.

Further, as storage location of data to be obtained is designated at the operation 6 of the image forming apparatus 1, communication software can be simplified and the software can be easily developed.

As an inquiry is made about the information "Content-type" to the server, and the format of image is determined based on the response to the inquiry, printing can be normally performed even if URL extension does not exist.

[Second Embodiment]

Hereinbelow, the second embodiment of the present invention will be described. In the following description, explanations of elements corresponding to those of the above-described first embodiment will be omitted, and the characteristic feature of the second embodiment will be mainly described.

FIG. 5 is a block diagram showing the configuration of network system including the image forming apparatus 1 according to the second embodiment of the present invention. In this figure, elements corresponding to those in FIG. 1 have the same reference numerals, and explanations of the elements will be omitted.

As the second embodiment, the image forming apparatus obtains the desired data by the HTTP protocol based on a URL inputted from another apparatus connected to the network 32, generates image data based on the obtained data and performs image formation.

In the present embodiment, information on a location where data to be obtained is stored is inputted as a URL from a client apparatus 24 connected to the network 32, the input URL information is transmitted to the image forming apparatus 1, then the image forming apparatus 1 receives the information, obtains the data from the server 7 and performs image formation.

In FIG. 5, numeral 24 denotes a client apparatus having a function of designating data to be obtained by the image forming apparatus 1 and used in image formation. Numeral 4*a* denotes an image processing circuit basically having approximately the same function as that of the above-described image processing circuit 4. The construction of the image processing circuit 4*a* will be described later with reference to FIG. 6. Numeral 5*a* denotes a binary printer, and its construction will be described in detail later with reference to FIG. 7.

Figure 6:
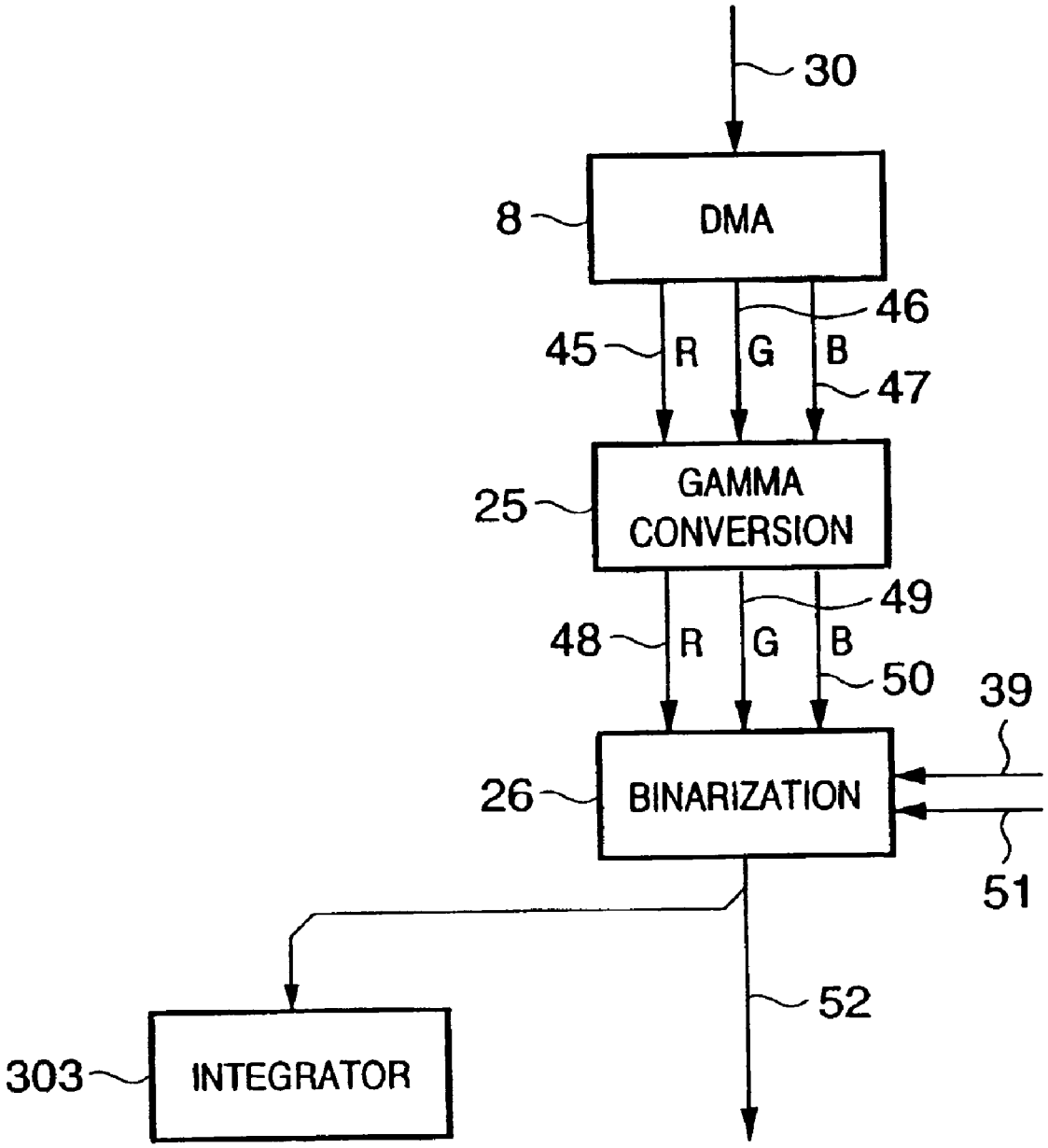
FIG. 6 is a block diagram showing the construction of the image processing circuit according to the second embodiment.

FIG. 6 is a block diagram showing the construction of the image processing circuit 4*a* according to the present embodiment. In this figure, elements corresponding to those in FIG. 2 have the same reference numerals.

In FIG. 6, numeral 8 denotes a DMA data transfer circuit which controls DMA transfer of image data from the image memory 2; 25, a gamma conversion circuit which performs gamma conversion; 26, a binarization circuit which performs binarization on input image data to generate binary data; 45, an R data signal indicating red component data of image data; 46, a G data signal indicating green component data of the image data; 47, a B data signal indicating blue component data of the image data; 48, an R data signal converted by the gamma conversion circuit 25; 49, a G data signal converted by the gamma conversion circuit 25; 50, a B data signal converted by the gamma conversion circuit 25; 39, a color selection signal for selection of color of which image formation is to be made; 51, a binarization selection signal for selection of binarization method in the binarization circuit 26; and 52, an LED drive signal for on/off control on LED array.

The DMA data transfer circuit 8 is connected to the system bus 30, and is controlled via the system bus 30 by the CPU 101 which controls the overall image forming apparatus 1. In a case where image data stored in the image memory 2 is transferred to the image processing circuit 4*a* by DMA transfer by the DMA data transfer circuit 8, first, addresses of the image memory 2 where respective R, G and B image data are stored and transfer data size are set by the CPU 101 for the DMA data transfer circuit 8. Then the DMA data transfer circuit 8 sequentially reads the respective R, G and B image data from the image memory 2 by DMA, in synchronization with print operation of the printer 5*a*, and outputs the read data as the R data signal 45, the G data signal 46 and the B data signal 47 to the gamma conversion circuit 25 such that the respective R, G and B data are outputted in synchronization with each other. That is, the R, G and B data of each pixel are simultaneously outputted.

The R data signal 45, the G data signal 46 and the B data signal 47 inputted into the gamma conversion circuit 25 are gamma-converted based on a predetermined gamma conversion table, then the R data signal 48 is generated from the R data signal 45, the G data signal 49, from the G data signal 46, and the B data signal 50, from the B data signal 47, and the generated signals are outputted. The R data signal 48, the G data signal 49 and the B data signal 50 outputted from the gamma conversion circuit 25 are inputted into the binarization circuit 26. In the binarization circuit 26, a color to be outputted is selected based on the color selection signal 39, and a binarization method is determined based on the binarization selection signal 51. Note that in the present embodiment, the binarization circuit 26 selects one of a dither method and an error-diffusion method.

The dither method is converting luminance data into binary pattern based on a binarization pattern representing a density corresponding to the luminance as area tone representation and generating image formation data. The dither method is appropriate for printing images having clear area border lines and small amount tonality transition such as illustrations, figures and characters.

On the other hand, the error-diffusion method is performing binarization on a pixel to be binarized (pixel of interest) based on errors among original data of the pixel of interest, original data of binarized peripheral pixels, data generated by binarization of the original data of the peripheral pixels, and a random number. The error-diffusion method is appropriate for printing natural images having a large amount of tonality transition such as photographic data.

The binarized image data is outputted as the LED drive signal 52 to the printer 5*a*.

Further, the LED drive signal 52 is sent as binarized image data to the integrator 303 and integrated by the integrator 303. Since the area tone representation is made by the binary data, the integrator 303 may be a simple up counter. In such case, the integrator has a smaller circuit scale in comparison with that for PWM modulation. Further, integration is performed on each image data corresponding to each toner color, and the result of integration is read by the CPU 101 and stored into the memory 102. The CPU 101 reads the result of integration stored for respective toner colors from the memory 102, and immediately notifies them as toner consumption amount prediction data to the CPU 202 of the printer 5*a*.

Figure 7:
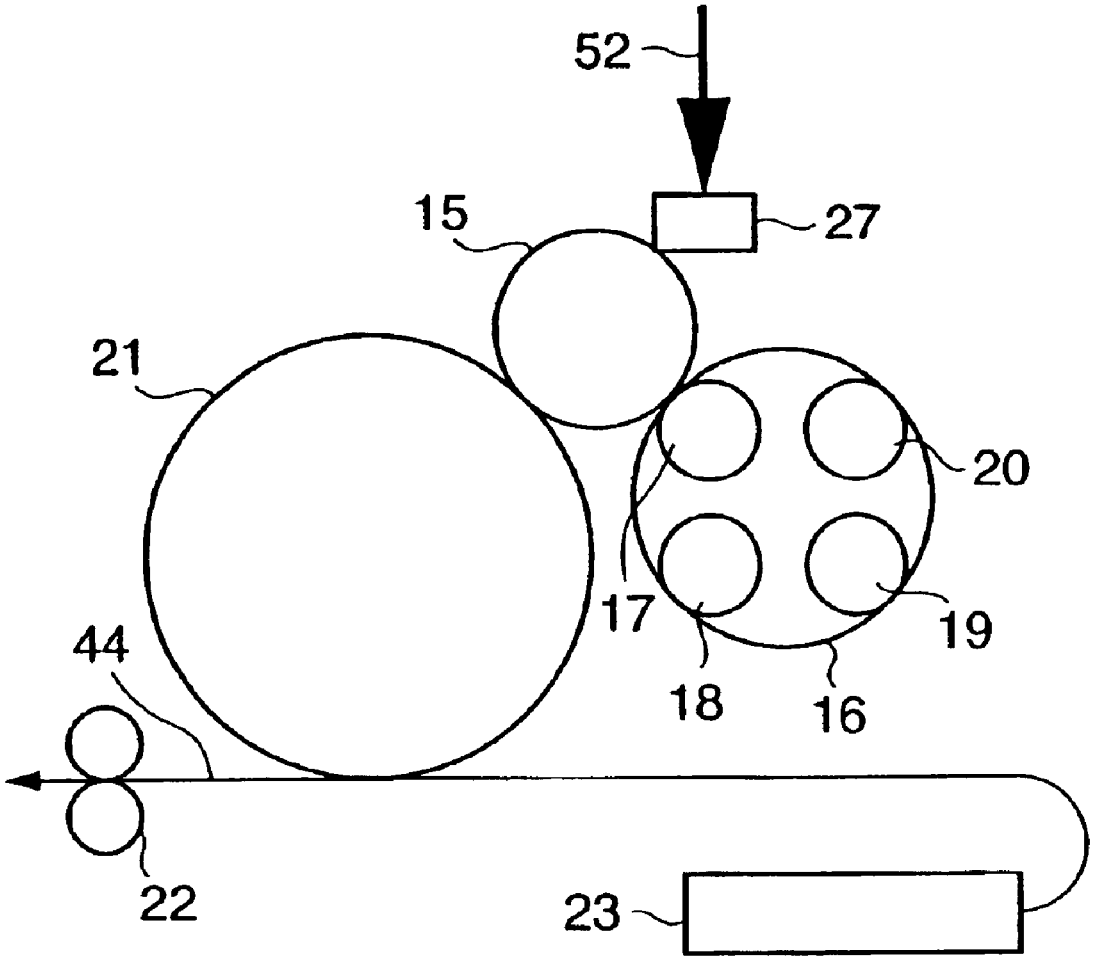
FIG. 7 is a block diagram showing the structure of the printer according to the second embodiment.

FIG. 7 is a block diagram showing the structure of the printer 5*a* according to the present embodiment. In this figure, elements corresponding to those in FIG. 3 have the same reference numerals, and explanations of the elements will be omitted.

In FIG. 7, numeral 27 denotes an LED array in which respective devices emit light in correspondence with the LED drive signal 52. A latent image is formed on the electrostatic drum 15 by light emission of the respective devices of the LED array. Numeral 52 denotes the LED drive signal.

The printer 5*a* performs image formation by the electrophotographic method. The printer 5*a* differs from the printer 5 based on the laser printing method of the first embodiment in that the printer 5*a* uses the LED array for image development.

Upon printing in the printer 5*a*, the LED drive signal 52 is supplied from the image processing circuit 4. The LED drive signal 52 is one of the C, M, Y and K image signals generated by binarization processing by the binarization circuit 26. First, the C image signal is inputted.

The LED array 27 has LED's arrayed in a straight line corresponding to the width of the electrostatic drum 15. Each LED has a size corresponding to the width of one pixel. When the LED drive signal 52 has supplied image data for 1 scan line for development, a latent image for 1 scan line is formed by LED light emission. Specifically, an LED corresponding to an ON portion of the LED drive signal 52 emits light, and the potential of the electrostatic drum 15 is high, on the other hand, an LED corresponding to OFF portion of the LED drive signal 52 does not emit light, and the potential of the electrostatic drum 15 is low. Thus a latent image is formed.

The latent image formed on the electrostatic drum 15 is first brought into contact with negatively-charged cyan toner included in the developer coated on the sleeve of the developer unit in the C toner cartridge 17 in a position where the electrostatic drum 15 comes into contact with the C toner cartridge 17. The cyan toner is attached by electric attraction only to LED-on portions of the electrostatic drum and developed. The toner-attached portions on the electrostatic drum 15 move by rotation of the electrostatic drum 15 to a position where the electrostatic drum comes into contact with the transfer drum 21. In the position where the electrostatic drum comes into contact with the transfer drum 21, the toner attracted to the electrostatic drum 15 is transferred to a print sheet attracted to the transfer drum 21.

Thereafter, the revolver 16 is rotated by ¼ of the entire perimeter such that the M toner cartridge 18 comes into contact with the electrostatic drum 15. Then, the M image signal is inputted as the laser drive signal 52, and the magenta toner is transferred onto the print sheet as in the case of C development. Upon development of each color, the color selection signal 39 is set to output the C image data as the LED drive signal 52 when C image is developed, and is set to respectively output the M, Y and K image data when M, Y and K images are developed. The development of the M, Y and K images are made as in the case of the C development, and transferred onto the print sheet attracted to the transfer drum 21.

Thereafter, the print sheet is separated from the transfer drum 21, passed through the paper conveyance path 44 and the two fixers 22. At this time, the print sheet is heated and pressed by the fixers 22, and the toner image transferred onto the print sheet is fixed to the print sheet. Then the print sheet is discharged to the outside the printer 5*a*. In this manner, printing is performed.

When the print operation is performed in the printer 5*a* in this manner, as the toner in the developer unit is consumed, it is necessary in two-component development using toner and magnetic carrier to perform toner supply control to appropriately supply toner by the amount of consumption to maintain an appropriate toner density.

For this purpose, upon print operation, the CPU 202 of the printer 5*a* controls toner supply from the toner bottles of the C, M, Y and K toner cartridges 17, 18, 19 and 20 to the respective color developer unit units, based on toner consumption amount prediction information for each toner color notified from the CPU 101 to the CPU 202.

Figure 8:
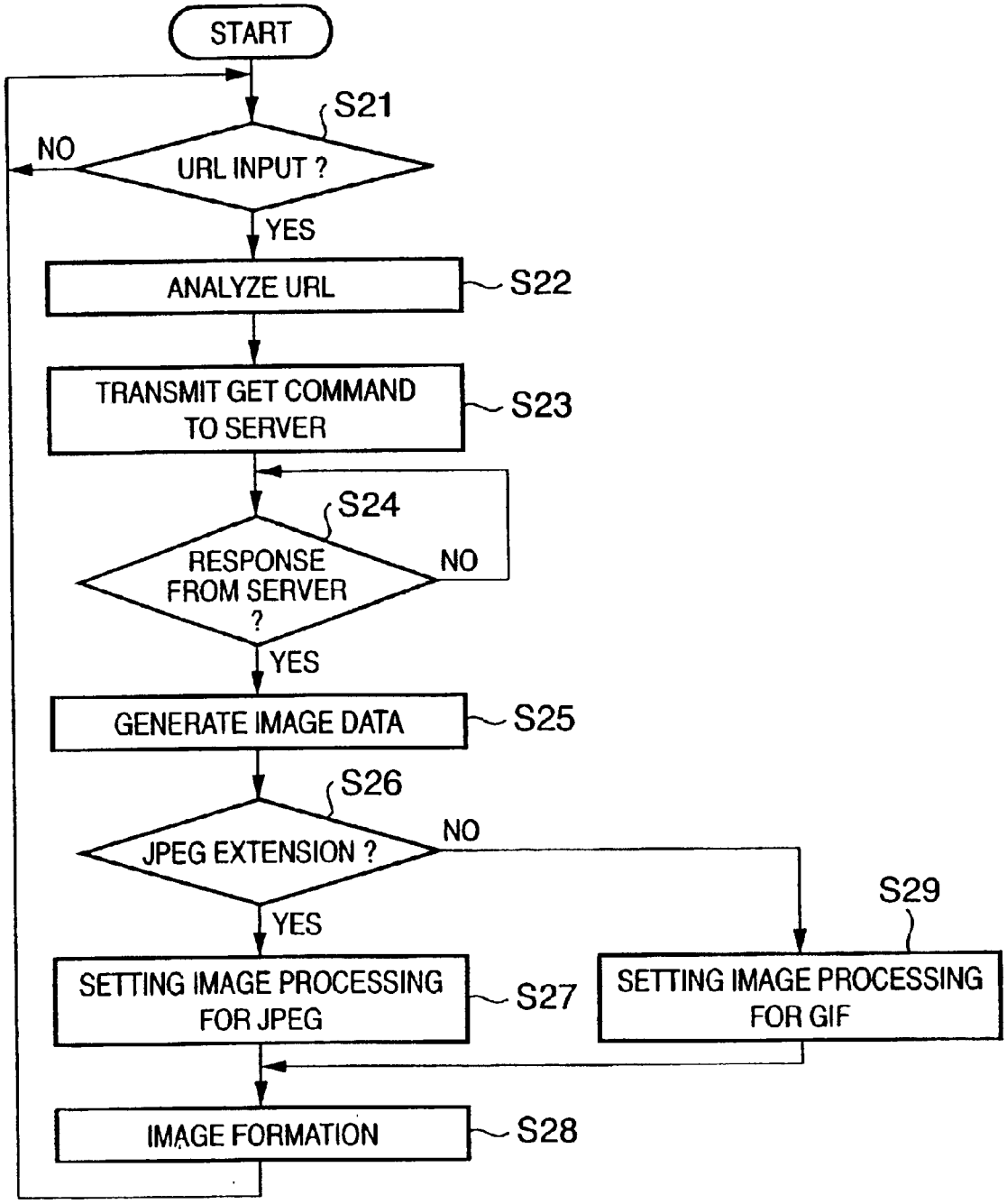
FIG. 8 is a flowchart showing the processing in the image forming apparatus according to the second embodiment.

FIG. 8 is a flowchart showing the processing in the image forming apparatus 1 according to the second embodiment. The control program for executing the processing is stored in the memory 102.

As shown in FIG. 5, the image forming apparatus 1 of the present embodiment is connected to the client apparatus 24 via the network 32. The client apparatus 24 is a data processing apparatus such as a personal computer from which a user inputs a character string. The user inputs data designating data to be print-outputted by the image forming apparatus 1 at the client apparatus 24. The format of the data is URL as in the case of the above-described first embodiment.

The user of the client apparatus 24 inputs a URL, then transmits the inputted URL to the image forming apparatus 1 via the network 32. The URL is received by the image forming apparatus 1 via the network 32 and the network interface 3. The image forming apparatus 1 is in an input waiting status until the input is made (step S21). At step S21, when the URL is inputted, the process proceeds to step S22, at which the structure of the inputted URL is analyzed, and an address of the server holding the desired data and location of the data in the server are specified. In this example, the data to be obtained exists in the server 7.

The process proceeds to step S23, at which the GET command for the data is issued to the server 7. The GET command is issued to the server 7 via the network interface 3 and the network 32.

The server 7 transmits the data designated by the GET command to the image forming apparatus 1 via the network 32 and the network interface 3.

When the response from the server 7 is received, the process proceeds from step S24 to step S25, at which image data is generated in the image memory 2 based on the data received from the server 7. Next, at step S26, it is determined whether the extension of the URL analyzed at step S22 is ".JPG" or ".jpeg" indicating a JPEG image. If the extension indicates a JPEG image, the process proceeds to step S27, at which image processing for JPEG image is set for the image processing circuit 4*a*. that is, a gamma table for natural image is set in the gamma conversion circuit 9, and the binarization method by the error-diffusion method is set in the binarization circuit 10.

On the other hand, if it is determined at step S26 that the extension does not indicate a JPEG image, the process proceeds to step S29, at which image processing for GIF image is set for the image processing circuit 4*a*. That is, gamma conversion table for illustration is set in the gamma conversion circuit 9 and the binarization method by the dither method is set in the binarization circuit 10. Thus, the image processing and binarization processing are performed at steps S27 and S29, then the process proceeds to step S28, at which image formation is performed by the printer 5*a* based on the image-processed and binarization-processed image data. Further, image data binarized by, the error-diffusion method in case of JPEG image or the dither method in case of GIF image, is integrated by the integrator for each toner color, and the result of integration is notified as toner consumption amount prediction information to the printer 5.

In this manner, the processing for performing image formation based on data stored on the server 7 designated from the client apparatus 24 is completed.

According to the above-described processing, regarding a JPEG image, gamma conversion for natural image is performed, and binarization is performed by the error-diffusion method. In this manner, image formation is performed with color tone and binarization appropriate for natural image.

Further, regarding a GIF image, gamma conversion for illustration is performed, and binarization is performed by the dither method. In this manner, image formation is performed with color tone and binarization appropriate for illustration.

However, as both types of images are converted into binary data, the number of dots is integrated by integrating binary data in a low-cost printer. That is, since the toner consumption amount is approximately proportional to the number of dots, the integration circuit can be simplified.

As described above, according to the present embodiment, a JPEG image is formed by image processing appropriate for printing of natural image, while a GIF image is formed by image processing appropriate for printing of illustration or the like. Thus even in the area tone representation, the toner consumption amount information is notified to the printer and appropriate toner supply control can be performed.

Further, advantageous characteristic of the second embodiment are as follows.

As an address where desired data is stored is designated in the client apparatus, the operation unit in the image forming apparatus 1 is omitted, and the cost of the apparatus can be reduced.

Binarization processing appropriate to image type is possible.

Since the image type is determined by the extension of URL, other protocols than the HTTP protocol can be used.

As described above, in the above first and second embodiments, the image processing circuit predicts the toner consumption amount from image data and notifies the predicted amount to the printer, thereby toner supply control in the printer can be approximately the same regardless of the structure of image forming unit. Even if the image forming apparatus is constructed such that various image processing boards are connected to the printer, it is not necessary to greatly change the control on the printer.

In this manner, the image processing boards for various image processings can be used in accordance with the cost and function desired by the user without increasing the cost of the printer, and further, as design of the printer can be made in common, the period of development of the printer can be reduced, and a common printer can be easily provided.

Further, even if the combinations between various types of image data from the network and image forming apparatuses for print output increase, appropriate toner supply control can be performed.

[Other Embodiment]

Note that in the above description, the first and second embodiments have been described independently, however, the present invention is not limited to these embodiments, but it may be arranged such that, e.g., the printer 5*a* of the second embodiment is employed in the first embodiment. Further, the image processing circuit 4 of the first embodiment may include the function of the image processing circuit 4*a* of the second embodiment. Further, the image processing circuits 4 and 4*a* may have, not all the image processing functions shown in FIGS. 2 and 6 but parts of the functions.

In the first embodiment, the type of image data is determined based on the format information from the server, then the UCR processing is performed on the image data in correspondence with the type of image data, and the C, M, Y and K multivalue image data corrected via the LUT 302 are integrated by the integrator 301 by ON/OFF of PWM modulated laser light; however, the determination of image data may be made by the extension of URL as in the case of the second embodiment, and the multivalue image data may be PWM modulated by the image processing circuit of the first embodiment.

In this manner, in the image processing circuit of the first embodiment, if the image type is determined by the extension of URL, selection of tonality-oriented processing or resolution-oriented processing can be appropriately made by selecting appropriate image processing in correspondence with determination of image type as a JPEG image or a GIF image. If it is determined by the extension of URL that the image is a JPEG image, the tonality-oriented processing is selected, the PWM modulation is performed at a frequency ½ of that of the clock signal, then the tonality-oriented correction data is selected in the LUT 302 for image data integration, and the result of integration by the integrator 301 is notified to the printer 5. Further, if it is determined by the extension of URL that the image is a GIF image, the resolution-oriented processing is selected, the PWM modulation is performed at the frequency of the clock signal, then the resolution-oriented correction data is selected in the LUT 302 for image data integration, and the result of integration by the integrator 301 is notified to the printer 5.

In this manner, as appropriate image processing is selected by the extension of URL and appropriate correction is performed for image data integration processing, the toner consumption amount can be excellently predicted, and an appropriate toner density can be maintained in the printer 5.

The present invention can be applied to a system constituted by a plurality of devices (e.g., a host computer, an interface, a reader and a printer) or to an apparatus comprising a single device (e.g., a copy machine or a facsimile machine).

Further, the object of the present invention can be also achieved by providing a storage medium holding software program code for performing the aforesaid processes to a computer system or an apparatus (e.g., a personal computer), reading the program code with a CPU or MPU of the computer system or apparatus from the storage medium, then executing the program.

In this case, the program code read from the storage medium realizes the functions according to the embodiments, and the storage medium holding the program code constitutes the invention.

Further, the storage medium, such as a floppy disk, a hard disk, an optical disk, a magneto-optical disk, a CD-ROM, a CD-R, a DVD, a magnetic tape, a non-volatile type memory card, and ROM can be used for providing the program code.

Furthermore, besides aforesaid functions according to the above embodiments are realized by executing the program code which is read by a computer, the present invention includes a case where an OS (operating system) or the like working on the computer performs a part or entire actual processing in accordance with designations of the program code and realizes functions according to the above embodiments.

Furthermore, the present invention also includes a case where, after the program code read from the storage medium is written in a function expansion card which is inserted into the computer or in a memory provided in a function expansion unit which is connected to the computer, a CPU or the like contained in the function expansion card or unit performs a part or entire actual processing in accordance with designations of the program code and realizes the functions of the above embodiments.

If the present invention is realized as a storage medium, program code corresponding to the above-described flowcharts (FIG. 4 and/or FIG. 8) are to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus for forming an image in accordance with an electrophotographic method, said apparatus comprising:

storage means for storing image data;

image processing means for performing image processing on the image data stored in said storage means; and image formation means for forming the image using developer, wherein the formed image is based on the image data processed by said image processing means, wherein said image processing means includes developer consumption amount calculation means for generating information indicating a predicted amount of developer consumed by said image formation means, based on the image data processed by said image processing means, wherein said image formation means supplies developer in correspondence with the information generated by said developer consumption amount calculation means, wherein said image processing means changes the image processing on the image data based on whether the image data represents a tonality-oriented image or a resolution-oriented image, and wherein said developer consumption amount calculation means corrects the generated information in correspondence with an executed image processing.

2. An image forming apparatus according to claim 1, wherein said image processing means determines a type of image, tonality-oriented image or resolution-oriented image, the image data represents based on an extension included in a file name of the image data.

3. An image forming apparatus according to claim 1, further comprising reading means for reading an original image and generating image data, wherein said storage means holds image data generated by said reading means.

4. An image forming apparatus, connected to a network, for forming an image in accordance with an electrophotographic method, said apparatus comprising:

storage means for storing image data;

input means for inputting information on the image data;

issuance means for issuing an image request to said network, based on the information inputted by said input means;

image processing means for performing image processing on the image data stored in said storage means;

image formation means for forming the image using developer, wherein the formed image is based on the image data processed by said image processing means, wherein said image processing means includes developer consumption amount calculation means for generating information indicating a predicted amount of developer consumed by said image formation means, based on the image data processed by said image processing means, wherein said image formation means supplies developer in correspondence with the information generated by said developer consumption amount calculation means, and wherein said storage means holds image data transmitted in response to the image request issued by said issuance means.

5. A developer supply method for an image forming apparatus which forms an image in accordance with an electrophotographic method, said method comprising:

a storage step, of storing image data in storage means;

an image processing step, of performing image processing on the image data stored in said storage step;

an image formation step, of forming the image using developer, wherein the formed image is based on the image data processed in said image processing step and said image processing step includes a developer consumption amount calculation step, of generating information indicating a predicted amount of the developer consumed in said image formation step, based on the image data processed in said image processing step; and a supply step, performed after said image formation step, of supplying developer in correspondence with the information generated in said developer consumption amount calculation step, wherein, in said image processing step, image processing on the image data is changed based on whether the image data represents a tonality-oriented image or a resolution-oriented image, and wherein, in said developer consumption amount calculation step, the generated information is corrected in correspondence with an executed image processing.

6. A developer supply method for an image forming apparatus according to claim 5, wherein said image processing step includes determining, based on an extension included in a file name of the image data, a type of image, tonality-oriented image or resolution-oriented image, the image data represents.

7. A developer supply method for image forming apparatus according to claim 5, further comprising a reading step, of reading an original image and generating image data, wherein, in said storage step, the image data generated in said reading step is stored.

8. A developer supply method for an image forming apparatus, being connected to a network, which forms an image in accordance with an electrophotographic method, said developer supply method comprising:

a storage step, of storing image data in storage means;

an input step, of inputting information on the image data;

an issuance step, of issuing an image request to said network, based on the information inputted in said input step an image processing step, of performing image processing on the image data stored in said storage step;

an image formation step, of forming the image using developer, wherein the formed image is based on the image data processed in said image processing step and said image processing step includes a developer consumption amount calculation step of generating information indicating a predicted amount of the developer consumed in said image formation step, based on the image data processed in said image processing step; and a supply step, performed after said image formation step, of supplying developer in correspondence with the information generated in said developer consumption amount calculation step, wherein issued in said storage step, image data transmitted in response to the image request in said issuance step is stored in said storage means.

9. A computer program for executing a developer supply method for an image forming apparatus which forms an image in accordance with an electrophotographic method, said computer program comprising:

code for a storage step, of storing image data in storage means;

code for an image processing step, of performing image processing on the image data stored in said storage step;

code for an image formation step, of forming the image using developer, wherein the formed image is based on the image data processed at said image processing step and said image processing step includes a developer consumption amount calculation step of generating information indicating a predicted amount of the developer consumed when forming an image, based on the image data processed at said image processing step; and a supply step, performed after said image formation step, of supplying developer in correspondence with the information generated in said developer consumption amount calculation step, wherein, in said image processing step, image processing on the image data is changed based on whether the image data represents a tonality-oriented image or a resolution-oriented image, and in said developer consumption amount calculation step the generated information is corrected in correspondence with an executed image processing.

10. A storage medium storing a computer program for executing a developer supply method for an image forming apparatus, connected to a network, which forms an image in accordance with an electrophotographic method, said program comprising:

code for a storage step, of storing image data in storage means;

code for an input step, of inputting information on the image data;

code for an issuance step, of issuing an image request to said network, based on the information inputted in said input step;

code for an image processing step, of performing image processing on the image data stored at said storage step;

code for an image formation step, of forming the image using developer, wherein the formed image is based on the image data processed in said image processing step and said image processing step includes a developer consumption amount calculation step of generating information indicating a predicted amount of the developer consumed when forming an image, based on the image data processed at said image processing step; and a supply step, performed after said image formation step, of supplying developer in correspondence with the information generated in said developer consumption amount calculation step, wherein in said storage step, image data transmitted in response to the image request issued in said issuance step is stored in the storage means.

11. An image processing board of an image forming apparatus which forms an image in accordance with an electrophotographic method, said image processing board comprising:

an image processing circuit that performs image processing on input image data using a parameter designated from pre-set plural parameters; and an integration circuit that integrates each data value upon output of the image data resulted from the image processing performed by said image processing circuit, wherein said plural parameters are set in correspondence with a tonality-oriented image and a resolution-oriented image.

12. An image processing board according to claim 11, wherein said integration circuit has a correction circuit that corrects each data value in correspondence with the designated parameter.

13. An image processing board according to claim 11, wherein said image processing circuit includes at least one of a LOG conversion circuit, an under color removal circuit, a pulsewidth modulation circuit, a gamma conversion circuit, and a binarization processing circuit.

14. An image forming apparatus which forms an image in accordance with an electrophotographic method, said apparatus comprising:

an interface section, which receives image data and attribute data regarding a tonality of the image data from an image source;

a prediction operation determination section, which determines, in accordance with the attribute data, an operation to be used for predicting a consumption amount of developer in forming an image based on the image data;

a consumption amount prediction section, which calculates the predicted consumption amount of developer by performing the operation, determined by said prediction operation determination section, on the image data;

an image processing section, which performs image processing on the image data in accordance with the attribute data;

an image forming section, which forms the image using developer based on the image data processed by said image processing section; and a developer supply section, which supplies developer based on the predicted consumption amount.

15. A developer supply method for an image forming apparatus which forms an image in accordance with an electrophotographic method, said developer supply method comprising:

a reception step, of receiving image data and attribute data regarding a tonality of the image data from an image source;

a determination step, of determining, in accordance with the attribute data, an operation to be used for predicting a consumption amount of developer in forming the image based on the image data;

a prediction step, of calculating the predicted consumption amount of developer by performing the operation, determined in said determination step, on the image data;

an image processing step, of performing image processing on the image data in accordance with the attribute data;

an image forming step, of forming an image using developer based on the image data processed in said image processing step; and a supply step, of supplying developer based on the predicted consumption amount.

* * * * *

UNITED STATES PATENT AND TRADEMARK OFFICE

CERTIFICATE OF CORRECTION

PATENT NO. : 6,754,455 B2
DATED : June 22, 2004
INVENTOR(S) : Michio Kawase

It is certified that error appears in the above-identified patent and that said Letters Patent is hereby corrected as shown below:

Title page,
Item [57], ABSTRACT,
Line 5, "resulted" should read -- that resulted --.

Column 1,
Line 18, "browsing" should read -- browsings --;
Line 26, "stores" should read -- store --;
Line 37, "are" should read -- is --;
Line 38, "performs" should read -- perform --; and
Line 43, "contents," should read -- content --.

Column 3,
Line 1, "case" should read -- case where --;
Lines 10 and 15, "is" should be deleted; and
Line 50, "case" should read -- case where --.

Column 4,
Line 33, "resulted" should read -- that resulted -- and "to" should be deleted.

Column 5,
Line 40, "in" should read -- when --; and
Line 52, "processing" should read -- process --.

Column 8,
Line 12, "tree" should read -- three --.

Column 9,
Line 34, "cartridge," (second occurrence) should read -- cartridge; --; and
Line 55, "M (magenta)" should read -- M (magenta), --.

Column 10,
Line 39, "the" (second occurrence) should read -- of the --.

Column 11,
Line 60, "type." should read -- type is set. --.

Column 15,
Line 28, "the" (second occurrence) should read -- of the --.

UNITED STATES PATENT AND TRADEMARK OFFICE

CERTIFICATE OF CORRECTION

PATENT NO. : 6,754,455 B2
DATED : June 22, 2004
INVENTOR(S) : Michio Kawase

It is certified that error appears in the above-identified patent and that said Letters Patent is hereby corrected as shown below:

Column 16,
Line 13, "that" should read -- That --; and
Line 60, "characteristic" should read -- characteristics --.

Column 20,
Line 12, "for" should read -- for an --;
Line 25, "step" should read -- step; --; and
Line 42, "wherein" should read -- wherein, --.

Column 21,
Line 5, "step" should read -- step, --; and
Line 48, "resulted" should read -- that resulted --.

Signed and Sealed this

Twenty-third Day of August, 2005

JON W. DUDAS
*Director of the United States Patent and Trademark Office*